United States Patent [19]

Marzioli

[11] Patent Number: 4,888,946

[45] Date of Patent: Dec. 26, 1989

[54] ROVING FRAME APPARATUS FOR REMOVING BOBBINS AND REPLACING REMOVED BOBBINS WITH EMPTY TUBES

[76] Inventor: Pietro B. Marzioli, Via Durante, 1-25036 Palazzolo sull'Oglio Brescia, Italy

[21] Appl. No.: 245,736

[22] Filed: Sep. 16, 1988

[30] Foreign Application Priority Data

Oct. 2, 1987 [IT] Italy ..... 22134 A/87

[51] Int. Cl.[4] ..... D01H 9/04; D01H 9/10; D01H 9/18

[52] U.S. Cl. ..... 57/267; 57/268; 57/276

[58] Field of Search ..... 57/266, 268, 270, 276, 57/281

[56] References Cited

U.S. PATENT DOCUMENTS

| | | | |
|---|---|---|---|
| 4,473,997 | 10/1984 | Kawasaki et al. | 57/276 |
| 4,630,435 | 12/1986 | Igel | 57/281 |
| 4,769,982 | 9/1988 | Kogiso et al. | 57/281 |

*Primary Examiner*—John Petrakes

*Attorney, Agent, or Firm*—Bucknam and Archer

[57] ABSTRACT

The apparatus comprises a first conveyor belt extending along the perimetrical sides of a removing frame with which a second conveyor belt, a removing carriage and an operating board cooperate, the second conveyor belt being mounted on a horizontal upwardly and downwardly displaceable frame and being able to supply empty tubes to the operating board and the formed bobbins taken up from the board to the first conveyor.

5 Claims, 6 Drawing Sheets

ROVING FRAME APPARATUS FOR REMOVING BOBBINS AND REPLACING REMOVED BOBBINS WITH EMPTY TUBES

BACKGROUND OF THE INVENTION

The present invention relates to a roving frame apparatus for automatically removing bobbins and replacing them with empty tubes on which roving is to be wound.

As is known, the operation of removing roving frame bobbins and replacing them with empty tubes on which roving must be wound is presently carried out in a manual manner with a great amount of labour.

In fact these manual operations require a comparatively long time with a consequent poor efficiency of the roving frames.

Known semi-automatic removing and replacing apparatus, on the other hand, are rather complex and of large size and do not afford the possibility of carrying out the mentioned operations in a completely automatic way.

SUMMARY OF THE INVENTION

Accordingly, the main object of the present invention is to overcome the above mentioned drawbacks by providing an automatic apparatus for removing the bobbins from roving frames and replacing them with empty tubes which is structurally very simple and reliable.

Another object of the present invention is to provide an automatic apparatus for removing bobbins from roving frames and replacing them with empty tubes which comprises means for facilitating repairing operations on broken rovings both during the bobbin forming step and during the formed bobbin doffing step.

Another object of the present invention is to provide such an automatic apparatus for removing bobbins from roving frames and replacing them with empty tubes which requires a very reduced maintenance and can be set for operation in a very simple way.

Still another object of the present invention is to provide such an automatic apparatus for removing bobbins from roving frames and replacing them with empty tubes which is able of reducing to a minimum the dead time required for doffing the formed bobbins, thereby greatly improving the efficiency of said apparatus.

SUMMARY OF THE INVENTION

According to one aspect of the present invention, the above mentioned objects, as well as yet other objects, which will become more apparent hereinafter, are achieved by an apparatus for removing bobbins from roving frames and replacing them with empty tubes, characterized in that it essentially comprises a first conveyor belt, which extends along the perimetrical sides of a roving frame, therewith a second conveyor belt, a removing carriage and an operating board cooperate which are capable of driving, by timed movements, empty tubes to said roving frame and formed bobbins from said roving frame to said first conveyor belt, this operating cycle being performed by suitable driving members which are controlled by suitable controlling means.

BRIEF DESCRIPTION OF THE DRAWINGS

Further characteristics and advantages of the automatic apparatus for removing bobbins from roving frames and replacing them with empty tubes according to the present invention will become more apparent hereinafter from the following description of a preferred embodiment thereof, which is illustrated, by way of an indicative but not limitative example, in the accompanying drawings, where.

DESCRIPTION OF THE PREFERRED EMBODIMENTS

Figure 1:
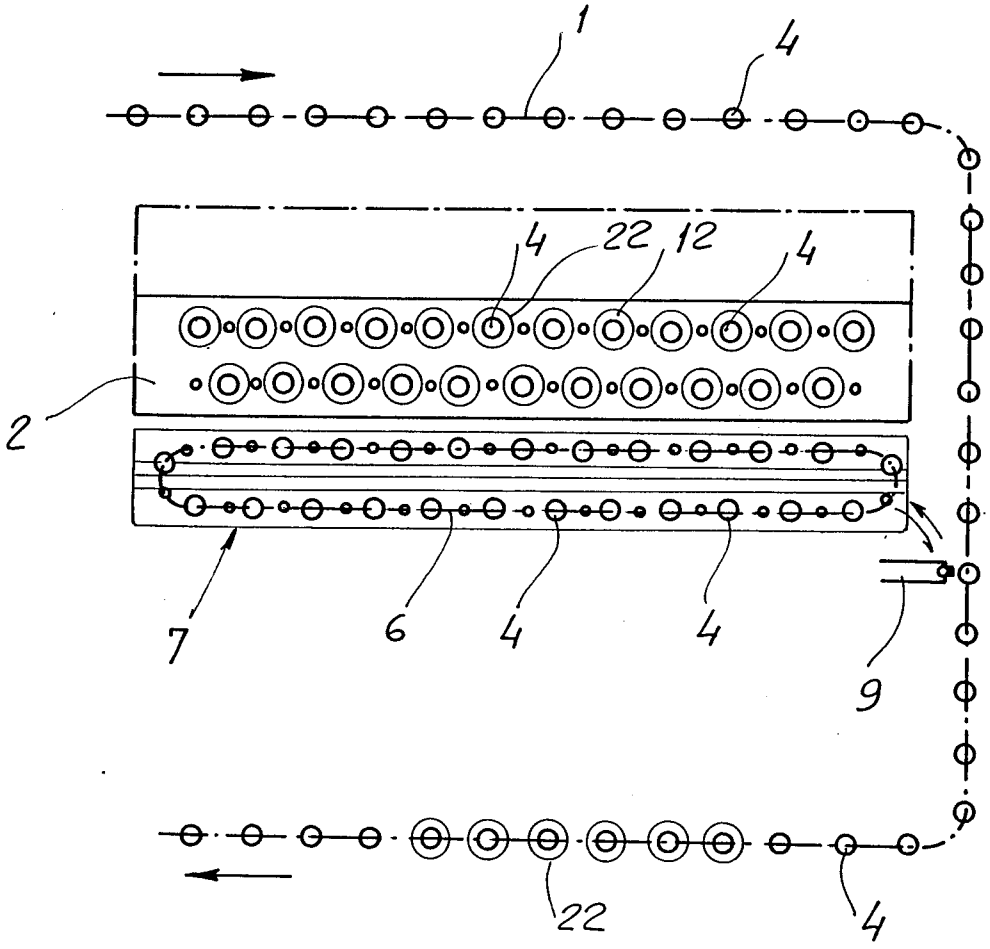
FIG. 1 shows an operating diagram of the apparatus according to the present invention.
Figure 3:
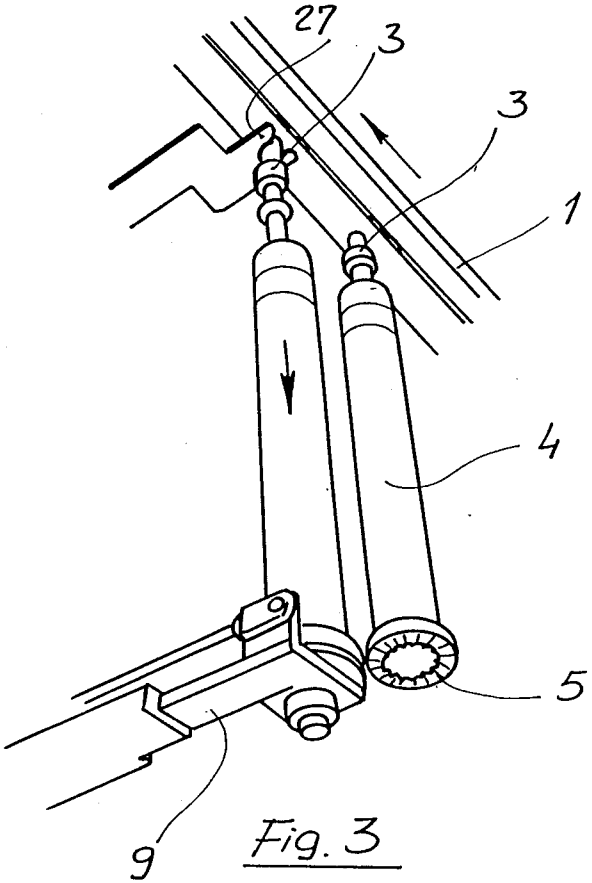
FIGS. 2 to 5 show a possible method for removing or doffing the formed roving bobbins and loading the empty tubes.

With reference to the above mentioned figures, the apparatus for automatically removing bobbins from roving frames and replacing them with empty tubes according to the present invention comprises a conveyor belt 1 which is fed from an operating machine or vessel (not shown) and extends along the perimetrical sides of the roving frame, indicated at the reference number 2, and feeds or supplies a further operating machine or vessel.

The first conveyor belt 1 is provided, at even spacings, with gripping and engaging devices 3, having downwardly extending axes and able of engaging corresponding tubular elements 4 provided with a respective bottom flange 5.

A second conveyor belt 6 cooperates with said first conveyor belt, said second conveyor belt substantially extending along two parallel legs having ends coupled by semicircular portions.

This second conveyor belt 6 is mounted on a respective frame or bridge 7 capable of downwardly or upwardly sliding on suitable vertically extending guides 20.

The mentioned frame or bridge also supports, at even spacings, a plurality of gripping or engaging elements having their axes downwardly directed and identical to the above mentioned gripping and engaging devices 3.

As is shown, said frame or bridge is arranged on the vertical line of an operating board 21 which is arranged at the front of the roving frame and thereon operators can walk for carrying out maintenance operations.

This operating board encloses, through a tiltable wing, two rows of pins 8 or pegs arranged at a distance which is a half of the distance separating the gripping or engaging devices of the mentioned second conveyor belt 6.

The apparatus further comprises an arm or replacing member 9 adapted to transfer the empty tubes 4 from the first conveyor belt 1 to the second conveyor belt 6 and the bobbins 22, formed on the roving frame, from the second conveyor belt or bridge 6 to the first conveyor belt.

More specifically, this arm or replacing member 9 is designed for movement along its longitudinal axis by means of a horizontal driving cylinder 10 and for upwardly and downwardly parallel movements by means of a vertical cylinder 11.

The mentioned arm 9, moreover, is capable of rotatively swinging in the two directions about a vertical axis 23 so as to displace its end portion 24, provided with a peg or pin member for restraining the tubes 4 at the bottom, from the first conveyor belt 1 to the second conveyor belt 6 and vice versa.

In this connection it should be pointed out that said arm or replacing member 9 is able, as it is rotated, to cause the conveyor belt 1 to advance for a distance corresponding to that between two of the mentioned gripping or engaging devices supported by said first conveyor belt.

More specifically, as the axle 23 is rotated a small carriage 26 will be displaced along horizontal sliding guides 25, through a rack-pignon assembly or other operatively equivalent means.

The carriage 26 supports a double acting cylinder (not shown) on the rod of which there is mounted a fork member 27 the legs of which are so designed and arranged as to be able of encompassing one of said gripping or engaging devices of the first conveyor belt 1.

Figure 2:
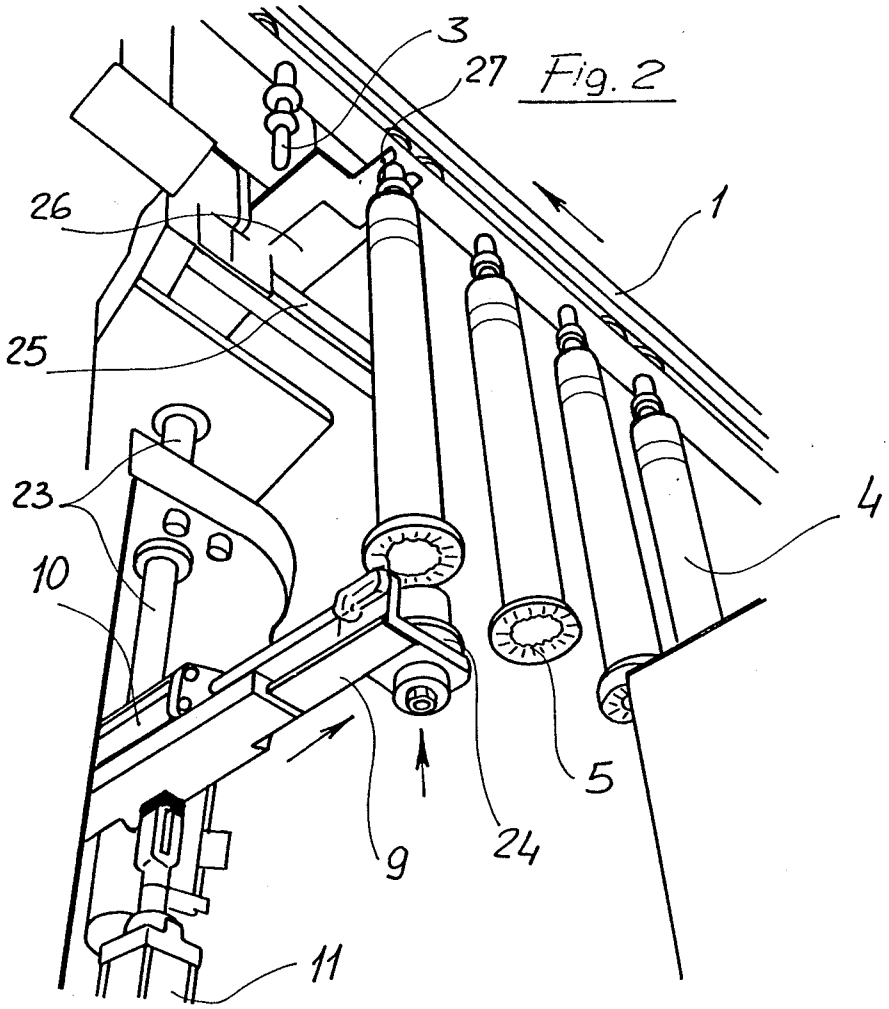
Figure 5:
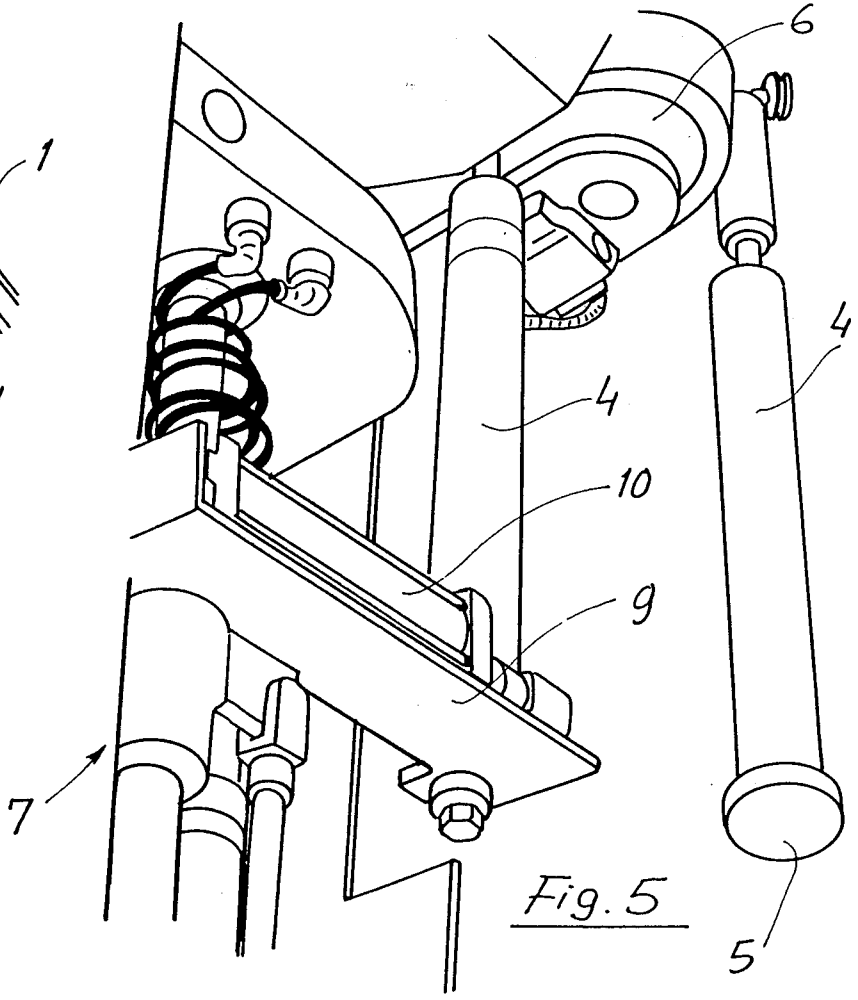
Figure 4:
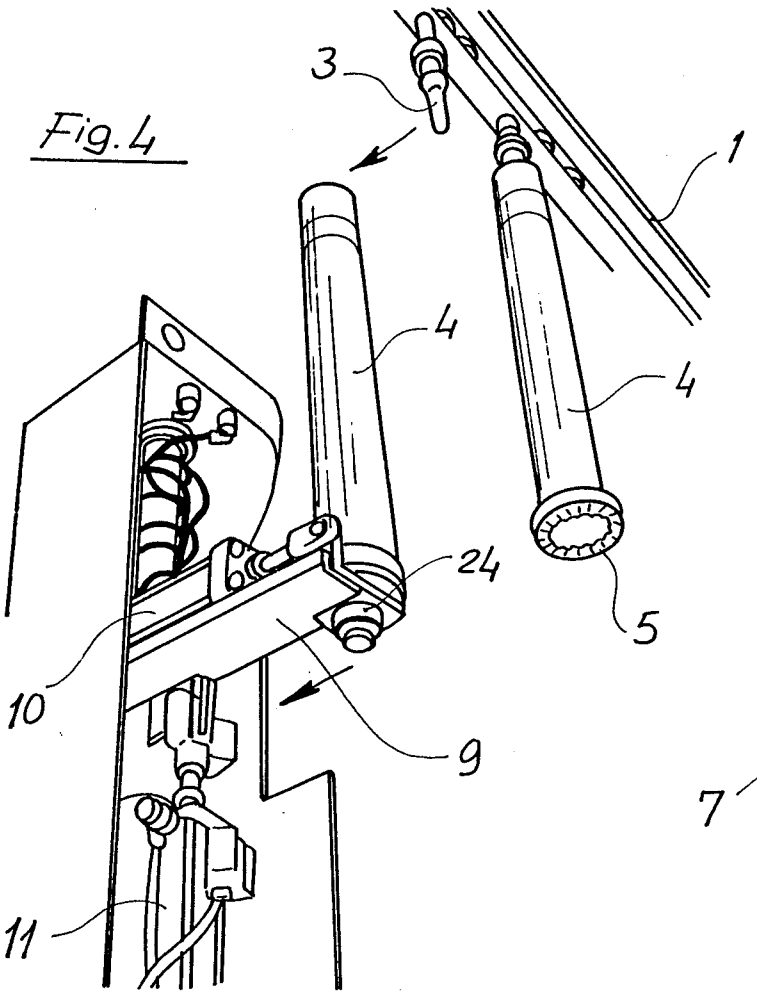
Figure 7:
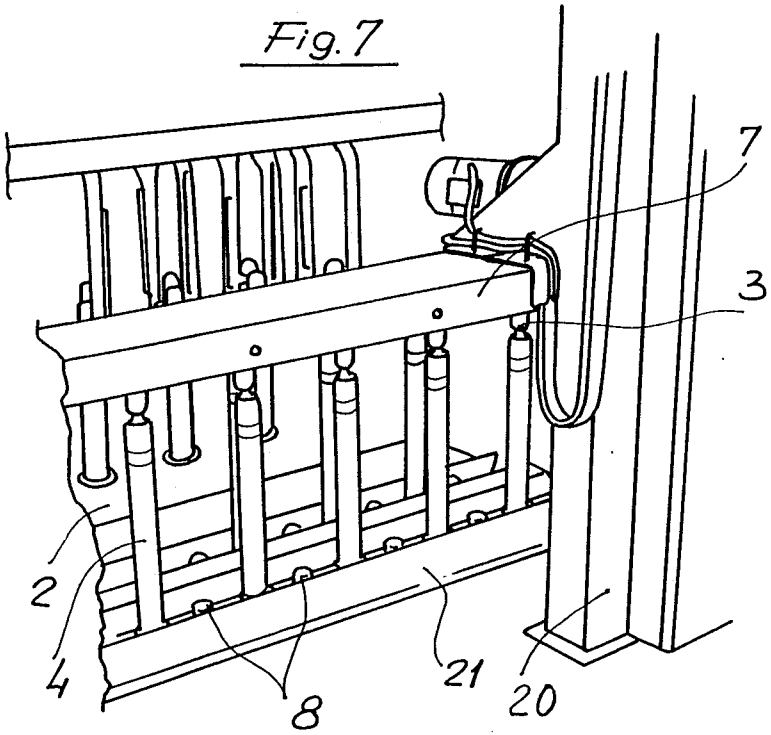
FIG. 7 shows a partial view of an operating board associated with the roving frame and of a second conveyor belt supplying said operating board.
Figure 6:
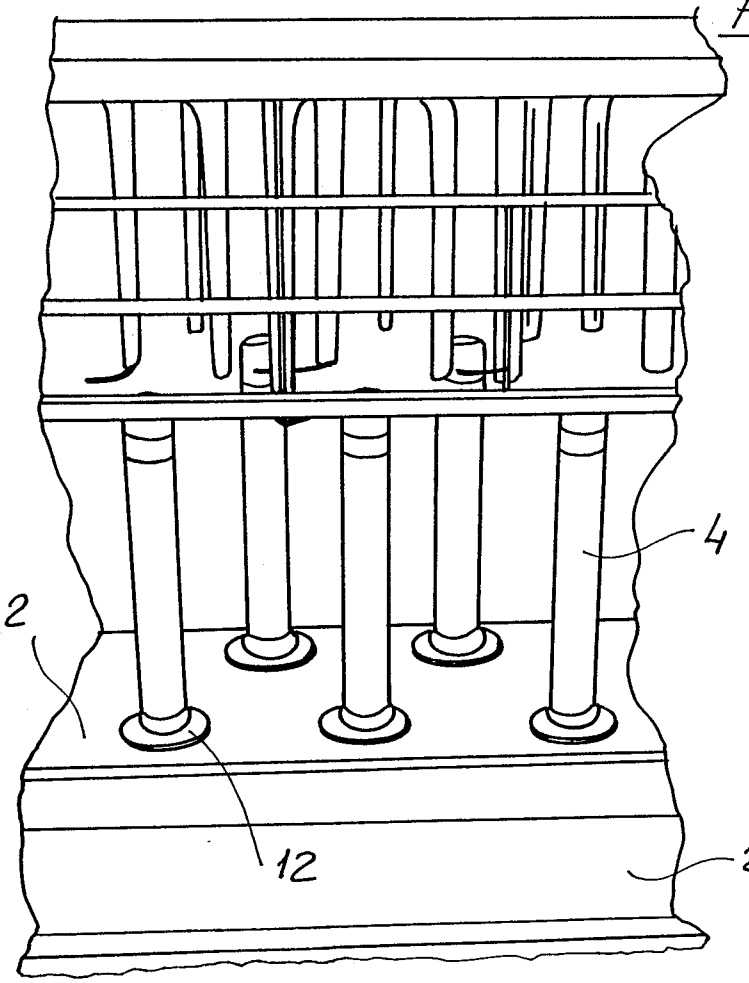
FIG. 6 shows a partial perspective view of a roving frame.

In particular, as the mentioned arm or replacing member 9 is rotated, the carriage 26, with the withdrawn fork member 27 will be displaced to the right end of the guides 25, as shown in FIG. 2.

Then the mentioned cylinder will cause said fork member 27 to engage with the front gripping device while a rotation in the opposite direction of said arm will cause said fork member to return to the left end portions of said guides 25.

The roving frame 2 further comprises bobbin rotating devices 12 arranged on two rows and evenly offset from one another, the number of said bobbin rotating devices being a half of the number of the pins or pegs of said operating board 21.

The same roving frame, moreover, can be displaced from a horizontal position, for winding the roving on the tubes and forming the roving bobbins 22, to a slanted position for doffing said bobbins by means of a suitable doffing or removing carriage indicated at the reference number 13.

In this connection it should be pointed out that the means for swinging the mentioned roving frame may be those disclosed in the Italia Patent No. 1,015,157 granted on May 10, 1977 in the name of the same Applicant.

Said doffing or removing carriage comprises one or more pneumatic cylinders (not specifically shown) and embedded in the body 14 for causing the cross-member 15 supporting a plurality of engaging grippers 16 to be lowered and raised.

The grippers 16 are evenly spaced and the number thereof corresponds to a submultiple of the bobbin rotating devices of the roving frame, said grippers being arranged with the same relative arrangement.

More specifically, the doffing carriage 13 is provided with a swinging movement about an outer horizontal axis and with a translation movement along horizontal guides.

The mentioned swinging movement, in particular, will cause said carriage to assume a slanted attitude in which the bobbins are formed and a horizontal attitude for doffing the formed bobbins onto said operating board pins.

In this connection it should be apparent that the different positions of the carriage can be obtained by a simple rotation of said carriage.

During the operation of the apparatus, the tubes 4, conveyed by the conveyor belt 1, are supplied by the arm member 9 to the second conveyor belt or bridge 6.

After having formed the roving bobbins on the roving frame, the top wing of the operating board will be upwardly tilted to provide access to the pins or pegs 8 and in the same time the bobbin supporting frame will be lowered and suitably tilted.

Then the second conveyor belt or bridge 6 will be lowered so as to release empty tubes onto corresponding pins or pegs of said operating board 21.

Figure 9:
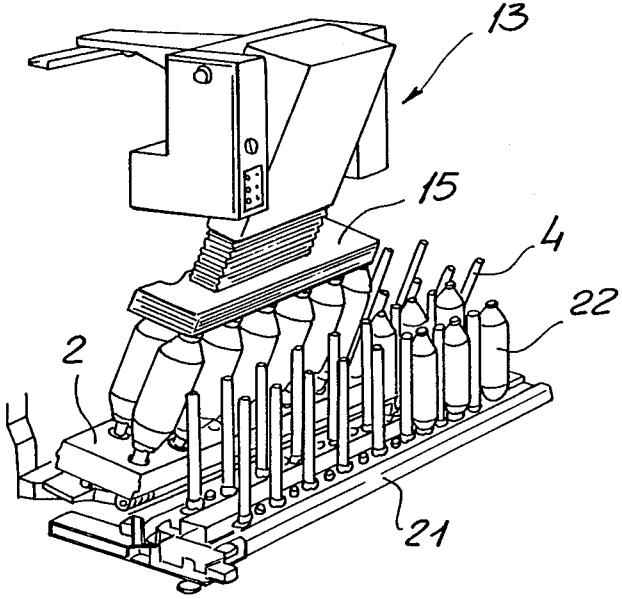
FIG. 9 shows a possible method for supplying the formed roving bobbins from said roving frame to the operating board.
Figure 8:
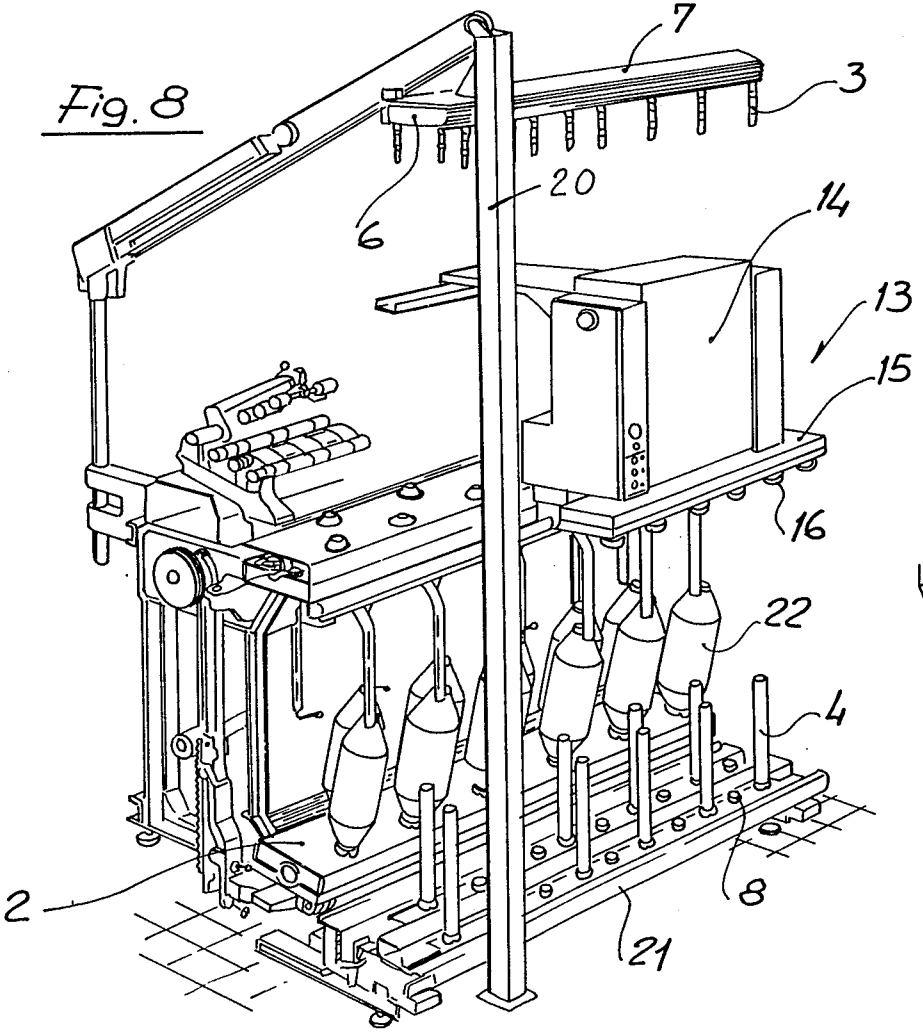
FIG. 8 is a schematic partial perspective view of the apparatus according to the present invention, with the formed roving bobbins arranged on the roving frame and the empty tubes arranged on said operating board.
Figure 10:
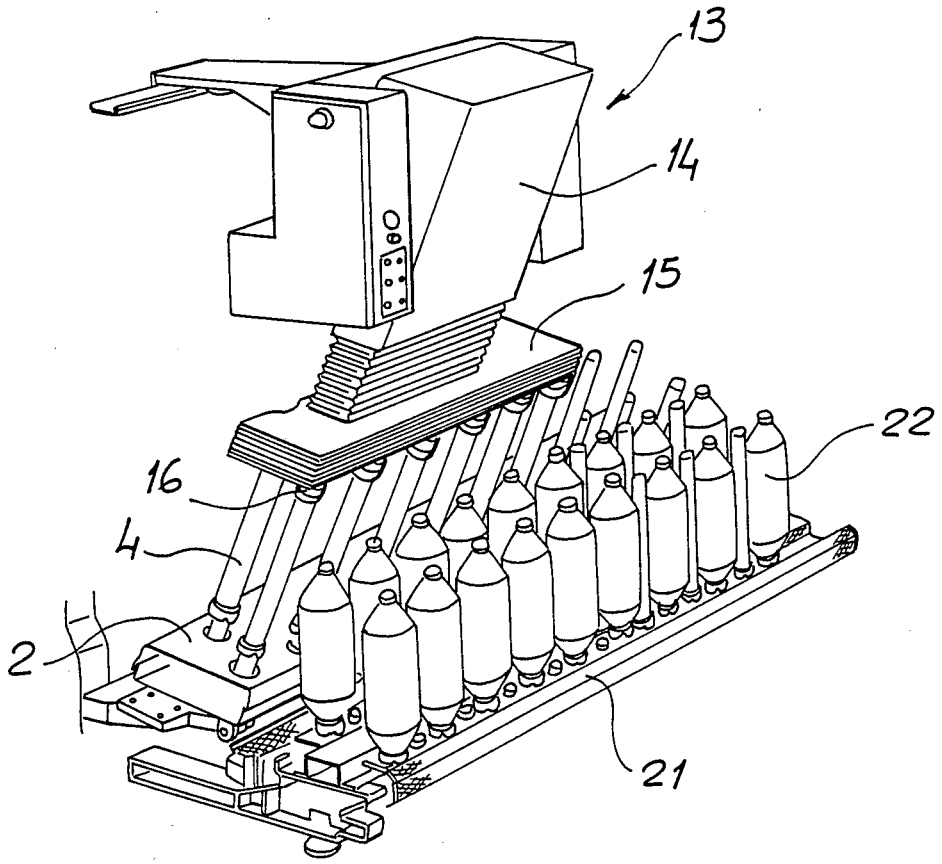
FIG. 10 shows a possible method for supplying the empty tubes from said operating board to said roving frame.

During the following operating step, the doffing carriage 13 will take up, by sets, the formed bobbins from the roving frame in a sequential way and will arrange them on the free pegs of the operating board (as shown in FIG. 9).

During a subsequent step, on the other hand, the doffing carriage 13 will take up empty tubes from the operating board after a displacement of said operating board along its longitudinal axis for a distance equal to the distance of two pins or pegs, thereby arranging said empty tubes on said roving frame for forming other roving bobbins.

Then the operating board 6 will be lowered again to take up the formed bobbins and transfer them, by means of said arm member 9, to the first conveyor belt 1.

From the above disclosure it should be apparent that the present invention fully achieves the intended objects.

While the invention has been disclosed and illustrated with reference to a preferred embodiment thereof, it should be apparent that the disclosed embodiment is susceptible to several modifications and variations all of which will come within the spirit and scope of the invention, as defined in the accompanying claims.

I claim:

1. An apparatus for removing bobbins from a roving frame and replacing removed bobbins with empty tubes, comprising a first conveyor belt, extending along perimetrical sides of said roving frame, with said first conveyor belt a second conveyor belt, a doffing carriage and an operating board cooperating, said second conveyor belt, doffing carriage and operating board being controlled to transfer said empty tubes to said roving frame and bobbins from said roving frame to said first conveyor belt, said first conveyor belt being provided with evenly spaced gripping devices for gripping corresponding tube elements having a respective bottom flange, said second conveyor belt comprising two parallel legs having end portions coupled by semicircular portions, and being mounted on a respective supporting frame adapted to slide downward and upward on vertical guides, said second conveyor belt bearing a plurality of said evenly spaced gripping devices, said operating board, arranged at the front of said roving frame, enclosing, through a tiltable wing, two rows of pin members spaced with a distance which corresponds to a half of the distance separating two said gripping devices of said second conveyor belt, said apparatus further comprising an arm member adapted to transfer said empty tubes from said first conveyor belt to said second conveyor belt and said bobbins, formed on said roving frame, from said second conveyor belt to said first conveyor belt, said arm member being displaced along a longitudinal axis by a horizontal cylinder and, upward and downward by a vertical cylinder, said arm member rotatively reciprocating about a vertical axis so as to displace one end thereof, provided with a pin member for engaging said empty tubes, from said first conveyor belt to said second conveyor belt and then from said second conveyor belt to said first conveyor belt.

2. An apparatus according to claim 1 wherein said arm member is adapted, as it is rotated, to displace said first conveyor belt for a distance equal to that of said two gripping devices on said first conveyor belt, and to further displace on horizontal sliding guides, through a rack-pignon assembly, a carriage supporting a double acting cylinder having a rod on which there is mounted a fork member comprising two legs which encompass one of said gripping devices on said first conveyor belt.

3. An apparatus according to claim 1 wherein said roving frame is provided with two rows of bobbin rotating evenly spaced devices provided in a number equal to a half of said pin members on said operating board, said roving frame being driven to be displaced from a horizontal position in which said bobbins are formed to a slanted position in which said formed bobbins are doffed by a doffing carriage.

4. An apparatus according to claim 3 wherein said doffing carriage comprises at least a pneumatic cylinder for lowering and raising a cross-member supporting a plurality of evenly spaced grippers, provided in a number corresponding to a submultiple of the number of said bobbin rotating devices.

5. An apparatus according to claim 3 wherein said doffing carriage is driven for swinging about an outer horizontal axis and sliding along horizontal guides, said doffing carriage assuming, as rotatively driven, a slanted attitude in which said bobbins are formed and a horizontal attitude in which said bobbins are doffed on said operating board.

* * * * *